United States Patent [19]

Fishfader et al.

[11] Patent Number: 4,784,035

[45] Date of Patent: Nov. 15, 1988

[54] REMOTELY ACTUATED TOW LINE THROWING DEVICE

[76] Inventors: Stanley S. Fishfader, 5868 Compass Dr., Los Angeles, Calif. 90045; Sanford Friezner, 17836 Cathedral Pl., Encino, Calif. 91316; Keith L. Kirkeide, N. Regency 2, 9487 Regency Square Blvd., Jacksonville, Fla. 32203; Stanley G. Putzke, 3571 Oakes Dr., Hayward, Calif. 94542; Stanley J. Singer, #54, 2100 W. Palmyra Ave., Orange, Calif. 92668

[21] Appl. No.: 933,808

[22] Filed: Nov. 24, 1986

[51] Int. Cl.[4] ..... F41F 5/04

[52] U.S. Cl. ..... 89/1.34; 102/504; 89/28.1

[58] Field of Search ..... 89/1.34, 28.05, 28.1; 42/105; 114/252, 253, 254; 102/504

[56] References Cited

U.S. PATENT DOCUMENTS

| | | | |
|---|---|---|---|
| 2,472,136 | 6/1949 | Whitlock | 89/28.05 |
| 3,505,926 | 4/1970 | Johnson | 89/1.34 |
| 3,837,107 | 9/1974 | Swaim et al. | 42/105 |
| 4,077,349 | 3/1978 | Paul | 89/1.34 |
| 4,189,703 | 2/1980 | Bennett | 114/254 |
| 4,275,680 | 6/1981 | Pennington et al. | 89/1.34 |

FOREIGN PATENT DOCUMENTS

| | | | |
|---|---|---|---|
| 11697 | of 1902 | United Kingdom | 102/504 |

*Primary Examiner*—Deborah L. Kyle
*Assistant Examiner*—Stephen Johnson
*Attorney, Agent, or Firm*—Charles H. Schwartz; Ellsworth R. Roston

[57] ABSTRACT

A throwing device including, a throwing gun formed by a high pressure chamber located within a low pressure chamber. A first frangible diaphragm having a predetermined breaking pressure interconnecting the two chambers. A second frangible diaphragm closing off the lower pressure chamber and having a predetermined breaking pressure lower than the breaking pressure of the first diaphragm. A barrel mounted adjacent to and extending from the second frangible diaphragm. A projectile located within the barrel. A main charge substantially located within the high pressure chamber and an ignition charge coupled to the main charge for igniting the main charge upon activation of the ignition charge. The ignition of the main charge providing for the production of rapid burning forming gas having an increasing pressure within the high pressure chamber. When the pressure reaches the predetermined breaking pressure for the first flangible diaphragm, the first diaphragm bursts to allow the high pressure gas to escape by rapidly expanding into the low pressure chamber. When the pressure in the low pressure chamber raeches the predetermined breaking pressure for the second flangible diaphragm, the second diaphragm bursts to allow the low pressure gas to escape into the barrel to propel the projectile located within the barrel.

56 Claims, 3 Drawing Sheets

FIG. 1
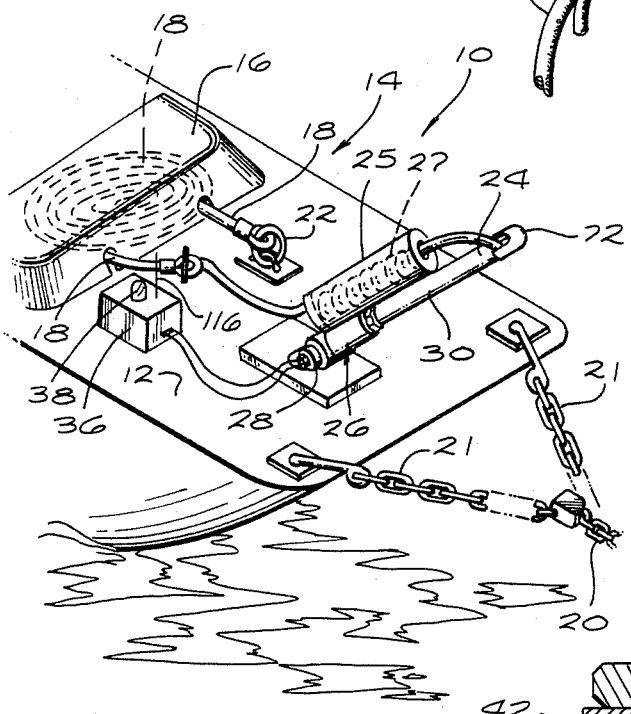
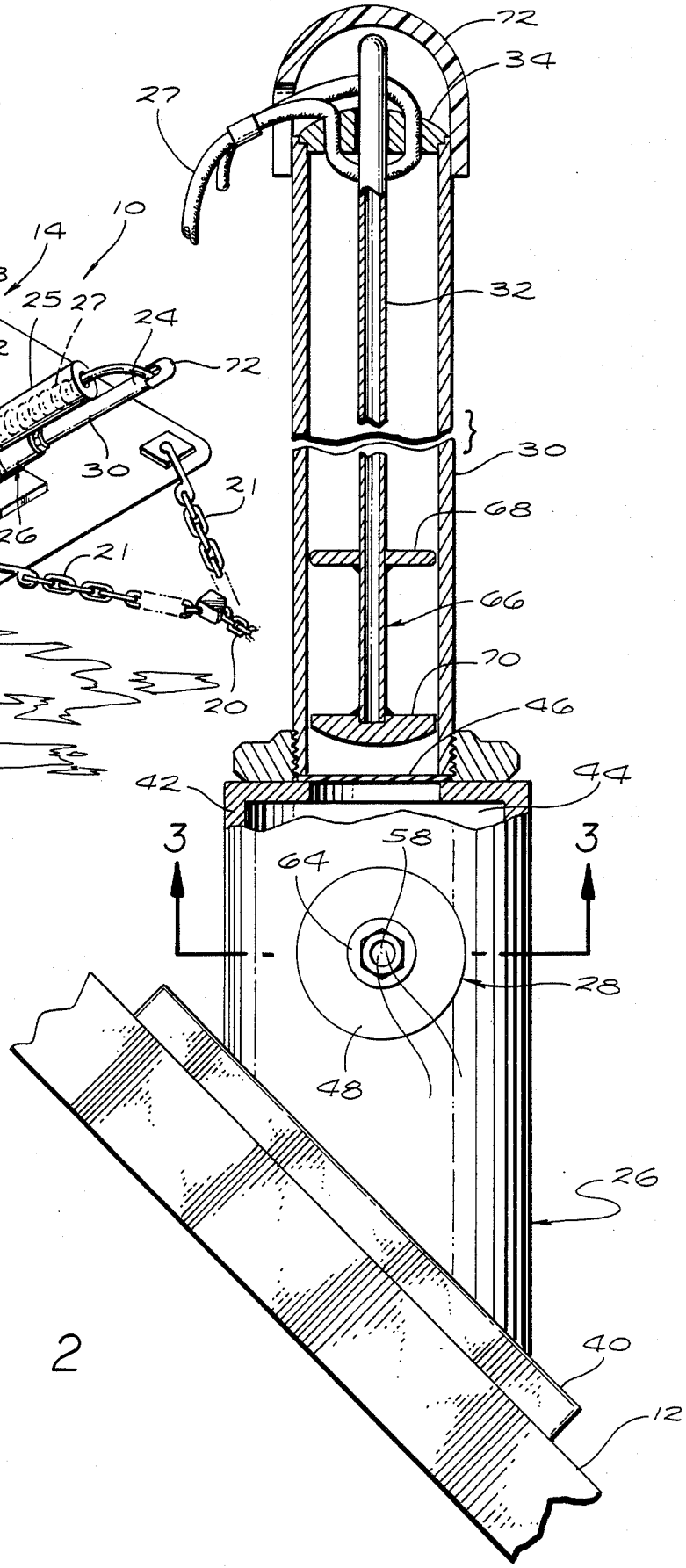
FIG. 2

FIG. 3
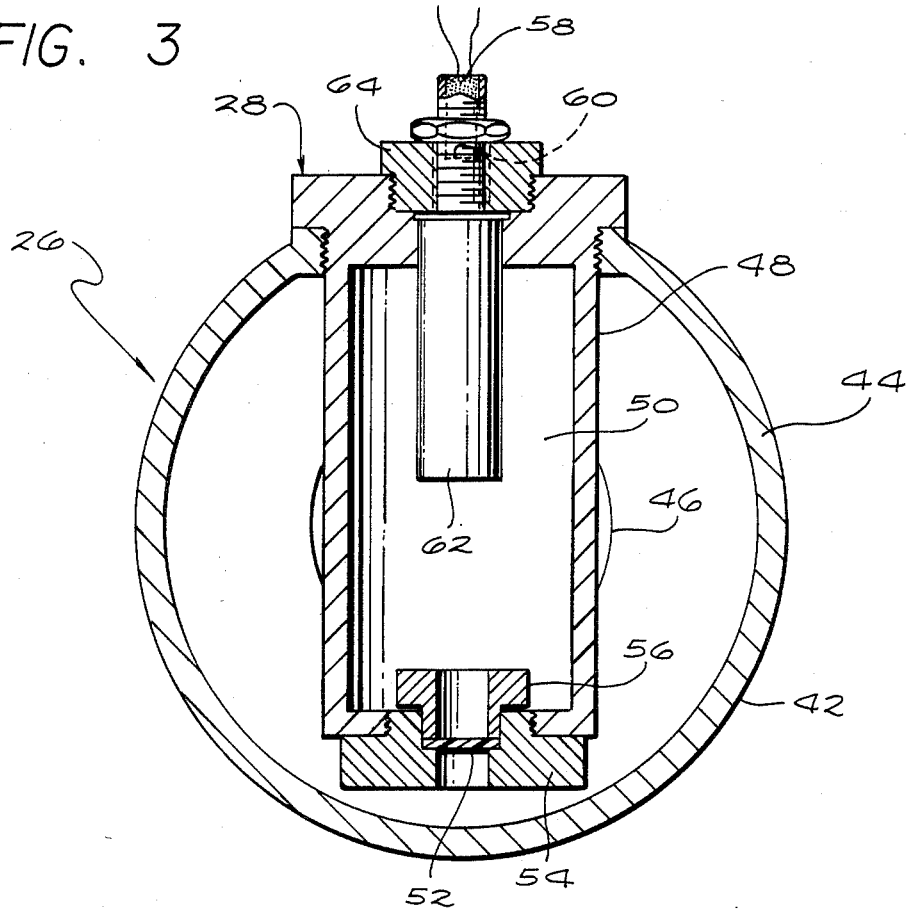
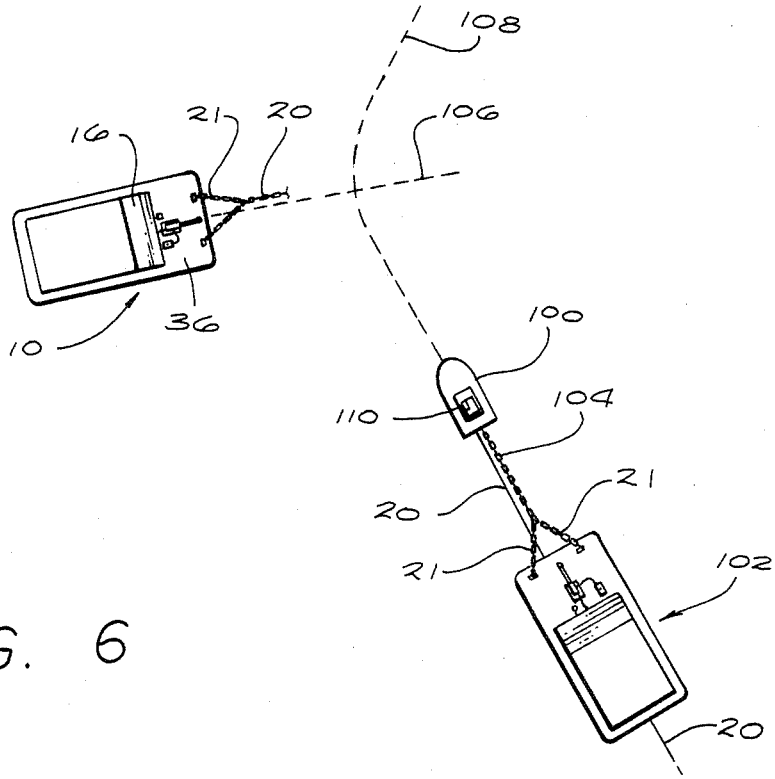
FIG. 6

REMOTELY ACTUATED TOW LINE THROWING DEVICE

BACKGROUND OF THE INVENTION

1. Field of the Invention

The present invention relates to a remotely actuated towline throwing device. Specifically, the present invention relates to a towline throwing gun which may be permanently mounted on an unmanned sea going vessel such as a barge and with this throwing gun remotely actuated to provide for a rescue of the barge in the event of a separation of the original towline which is being used to tow the barge.

2. Description of the Prior Art

In the current operation of tugboats in the open ocean, the tugboat and and towed vessel, such as a barge, is interconnected through the use of a heavy towline. This towline may be made of wire rope of synthetic rope which is attached at one end to the barge and at the other end to the tugboat so that the tugboat provides for the propulsion to move the barge through the water to its desired destination.

One difficulty which can arise is a breakage or separation of the towline or a breakage of a towline connection. When the barge is actually in the open ocean, this can occur because of the heavy loads on the towlines and connections and because the barges are often being towed through stormy conditions which creates turbulent seas. Because the tow unit is normally unmanned the tugboat must somehow reconnect a towline to prevent the towed unit from drifting or from grounding. Since, as indicated above, the breakage of the towline often occurs under storm conditions, the recapture of the towed unit presents a serious and dangerous problem.

If the weather as well as the seas is calm, it would be possible for the tugboat to maneuver close to the drifting barge so that personnel can be sent out to board the barge to assist in re-establishing a new towline. During stormy weather and high seas, it would be dangerous to try to have personnel transferred from the tug to the barge, or even to maneuver the tugboat too close to the barge. Actually, even with calm seas it would be safer not to have to send personnel from the tugboat to the barge.

In order to eliminate the need for personnel to transfer from the tugboat to the barge, the prior art has provided a method of recapturing the barge by the use of an insurance line or wire. This insurance line or wire forms an auxiliary or spare towing cable which is laid out or stored on the barge and has one end of the insurance line made fast to a towing pad. The other end of the insurance line is connected to a buoyant float line and with this buoyant float line streamed astern of the barge.

The storage of the insurance line may take a variety of different forms. For example, one type of barge which is currently employed in the Caribbean are generally referred to as triple deck barges. These barges are quite heavy because of their height and a single tug normally tows only one barge at a time. With this type of structure the insurance line extends from the tow pad at the front of the barge and along the side of the barge where it is held by clips. Additional length of this insurance line may be stored at the back of barge by folding the towline back and forth and with the folded line again being held in position by clips. A float line is connected to the insurance line and extends from the back of the barge to a permanent float in the water. If the original towline should break, the tugboat, since it is towing only one barge at a time, is normally free to try to manuever within 35 or 40 feet of the stern of the barge to try to pick up the floating line.

On the Westcoast, a great deal of towing is accomplished by the use of two separate flat barges towed from a single tugboat. Each barge is connected to the tugboat through the use of a separate tow wire and with the tugboat including a double drum winch to support both tow wires. Since the towline which extends from the tugboat to any barge should assume the shape of a catenary, the towline of the end barge will actually pass safely beneath the forward barge. Should one or the other of the towlines part, it now becomes necessary for the tug to try to manuever in close to the separated barge, but with the other barge still attached to the stern.

The attached barge, of course, limits the tugboat's ability to manuever and normally any pickup of the drifting barge must be done across its bow or stern and into the wind. This is because a drifting barge normally lays in the trough of the seas and swells and drifts sideways with the wind. This is why the pickup must be across the drifting tugs bow or stern as opposed to the side where the barge can drift down onto the tug and cause a collision. With the large flat barges used on the westcoast, the insurance line is normally stored on the top surface of the barge and along one edge. Again, the floating line drifts behind the barge.

With either of the two prior art systems described above, if the tugboat can manuever close enough to pick up the floating line, then the floating line is pulled on board the tugboat to theoretically pull in the insurance line. Since normally a portion of the insurance line is secured in position by clips, these clips must be of the type which either release or break as the floating line is pulled to deploy the insurance line. If all goes well, the insurance line is eventually reconnected to the tugboat and the barge is again under tow.

The above described prior art system has a number of serious limitations. First the prior art system depends on the tugboat being able to manuever close enough to capture the floating line. As indicated above, this may be difficult if the original line parted during stormy seas. Moreover, even in calmer weather, this system still requires that the tugboat be moved quite close to the barge and there is always the danger of a collision.

Another difficiency with the prior art system is that the insurance line is normally located either on the deck or the side of the barge and is thereby continually exposed to the elements and to salt water. Because of this exposure, the insurance line corrodes and can be of inadequate strength to sustain the forces of full towage when the need arises. Instead of serving as an emergency line, the insurance line upon being connected to the tugboat, may itself break and the problem of the loose barge has not been solved.

Another difficiency with the prior art system is the use of the float line that is trailed astern of the barge. This float line can be a very weak link snnce it is also exposed to the ultraviolet elements and can lose strength. This line may end up being so weak that it separates before the insurance line can even be brought on board the tugboat.

Even if the float line is of sufficient strength, the float line must be used in order to pull the insurance wire on baord the tug. However, the float line extends from the stern of the ship and the attached portion of the insurance line is located at the bow of the barge, and with an intermediate portion of the insurance line extending from the bow to the stern and connected to the float line. This intermediate portion of the insurance line must be cleared forward without hanging up or interfering with various portions of the barge which are attached to the deck of the barge and project upward. These portions may include expansions, bitts, cleats, chocks, etc.

It can be seen, therefore, that the prior art devices often fail to provide a reliable back up system to produce an emergency re-establishment of a towline between a tugboat and a barge in all types of weather conditions and which can operate reliably over long periods of time.

SUMMARY OF THE INVENTION

The present invention thereby provides for a remotely actuated towline throwing device which may be permanently placed on the unmanned towed vessel such as the barge. This remotely actuated device provides a mechanism for deploying an emergency towing line when desired. The emergency line may be remotely launched from the disabled barge a substantial distance into the ocean and may include a high strength floating line which can be easily retrieved by the tugboat. This eliminates the necessity of either placing personnel on board the barge, or in having to manuever very close to the barge to try to retrieve an insurance line which may be fragile due to long exposure.

The present invention has the advantages that it is safe and easy to use and is continuously functional at all times. A control of the remote actuation of the throwing devise rests solely with personnel on board the tugboat and the line is thrown a sufficient distance that it may be easily retrieved without having to manuever close to the disabled barge.

In order to provide for the throwing of the line a sufficient distance, the present invention incorporates a powering device which uses a minimum of a low explosive powder and with the explosive powder completely contained. This eliminates the use of any combustible materials which could be dangerous when placed on an unmaned vessel. For example, a rocket powered device could provide a significant problem of safety due to the open flame which projects from the rear of the rocket as the rocket would be launched from the ship. The present invention operates more like a gun in that an explosive powder is used to propel a shaft which carries the float line. However, the entire burning process is complete before the line carrying portion of the shaft clears the muzzle of the gun so that the gun is safe to operate on board the barge, even if the gun is positioned near combustibles located on the barge.

The actual structure of the gun is uniquely formed with a pair of pressure chambers, one located within the other. Specifically, a high pressure chamber is located within a low pressure chamber and with the explosive powder located within the high pressure chamber. When the explosive powder is ignited, it provides for essentially complete burning to produce a very high pressure gas. At a particular pressure, a high pressure frangible diaphragm bursts to release the gas into the low pressure chamber. The pressure in the low pressure chamber builds up to ultimately burst a low pressure frangible diaphragm to thereby provide for the force to propel a piston at one end of the shaft which carries the float line. The structure provides for the float line to be safely thrown for a sufficient distance such as 200 to 300 feet from the barge so that it may be safely picked up by the tugboat.

In order to insure that the remotely actuated gun cannot be inadvertently actuated by stray radio signals, the present invention also provides for a redundancy in the signaling system to eliminate any accidental actuation. Specifically, the signaling system depends on particular signals being sent over two separate channels and with both of these channels as well as a master switch being actuated simultaneously. Unless both channel signals are received at the same time, the remotely actuated towline throwing gun of the present invention cannot be operated.

Because the remotely actuated device of the present invention does not depend upon a float line permanently trailing from the barge, the emergency towline as well as the float line may be safely stored adjacent the throwing gun in a protected position. This greatly minimizes the exposure of the emergency towline and float line from corrosion and fatigue and insures that the device will operate properly when desired to allow for the retrieval of an emergency towline to reestablish contact with the disabled barge.

BRIEF DESCRIPTION OF THE DRAWINGS

A clearer understanding of the present invention will be had with reference to the following description and drawings wherein;

FIG. 1 is a perspective view of the remotely actuated towline throwing device mounted on the deck of a barge;

FIG. 2 is a partial cross-sectional view of the remotely actuated towline throwing device;

FIG. 3 is a cross-sectional view of the firing and launching assembly of the remotely actuated device;

FIG. 6 illustrates schematically the use of the remotely actuated device to pick up an emergency line from a drifting barge.

DESCRIPTION OF THE PREFERRED EMBODIMENT

Figure 4:
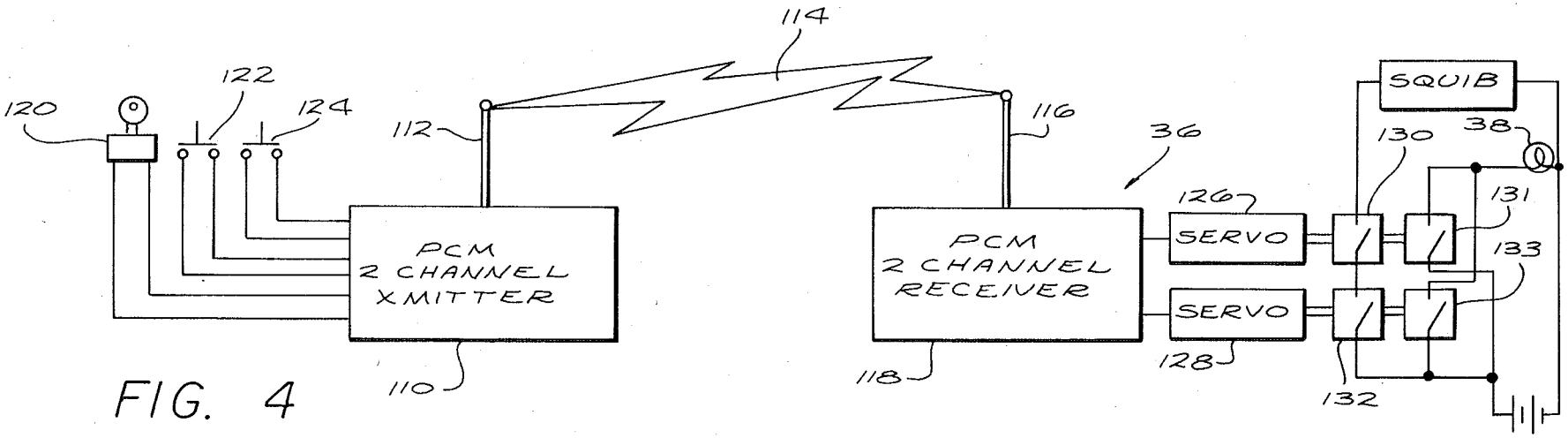
FIG. 4 is a block diagram of the transmitter receiver portion for the remotely actuated device.

As shown in FIGS. 1 and 2, a portion of a barge 10 is shown to have supported on the deck 12 a remotely actuated towline throwing device generally indicated by referenced numeral 14. The remotely actuated device 14 includes a container such as a stray shield 16 for storing an emergency line 18 which emergency line is to be deployed if a regular towline 20 becomes separated during towing of the barge 10. The towline 20 is connected to the barge 10 through a chain 21.

One end of the emergency towline 18 is connected to a towing pad 22 mounted securely to the deck 12. The other end of the emergency line 18 is coupled to a portion of a towline throwing gun 24. This portion may include a flotation cylinder 25 enclosing a coiled coupling line 27.

The towline throwing gun 24 includes a base portion 26 which is mounted to the deck 12 and which receives the ignition and launcher assembly 28. Extending from the base portion 26 is a barrel portion 30 for receiving a piston and with a shaft portion 32 extending from the barrel 30 and connected to the piston within the barrel 30. A ring member 34 surrounds the shaft portion 32 and with the free end of the emergency line 18 connected to the ring portion 34.

Also mounted on the deck 12 is a receiver 36 for receiving a transmitted signal to actuate the remotely actuated gun 24. The receiver 36 may be powered either by a battery located within the receiver or may be powered by a general purpose battery located on the barge 10 which general purpose battery would normally be used to provide for safety running lights when the barge is being towed at night. The receiver 36 may also include an incandescent light 38, which may be either mounted on the receiver or may be mounted in a position remote from the receiver and high enough so the light may be visible while the barge is being towed.

FIGS. 2 and 3 illustrate in more detail the base portion 26, including the ignition and launcher assembly 28. FIG. 3 illustrates a cross-sectional view looking upward, whereas FIG. 2 is a side view of the base portion 26. As can be seen in FIG. 2, a base plate 40 forms a strong securing member for attachment to the deck 12. Base plate 40 may be either bolted or welded to the deck, but in any event must be securely attached to the deck to provide for the proper support of the gun during launching of the emergency line. Extending from the base plate 40 is a cylindrical member 42, which cylindrical member actually forms the wall for a low pressure accumulator and with the area within the cylindrical member 42 acting as a low pressure chamber 44. A low pressure burst diaphragm 46 is positioned at the upper end of the cylinder 44 and forms a barrier between the cylinder 42 and the barrel member 30.

Extending into the cylinder 42 and at right angles is a second cylinder 48. The second cylinder 48 is the body portion for a high pressure chamber 50. At one end of the high pressure chamber 50 is a high pressure burst diaphragm 52. This burst diaphragm is held in position by an assembly including a member 54 threaded into the end of the cylinder 48 and a member 56 threaded into the member 54. The burst diaphragm 52 is, therefore, held between the members 54 and 56 and with the entire structure held at the end of the cylinder 48.

The other end of the cylinder 48 is formed as a thick wall which receives and supports a pressure cartridge 58 or squib which in turn is coupled to an ignition charge 60 which leads to a main charge 62. A retainer member 64 is threaded into the thick end wall of the cylinder 48 and with the retainer member 64 supporting the various charge members.

In general the operation of the ignition and launcher assembly is as follows. When a signal is received by the receiver 36, the signal is transmitted by wires to the pressure cartridge 58 to activate the pressure cartridge. The pressure cartridge is actually a mini detonator and when it fires, it causes the ignition charge 60 to ignite. This ignition charge 60 is actually a small volume of black powder, such as FFG black powder. The ignition charge 60 in turn ignites the main charge 62. This main charge may be formed of a standard commercial smokeless powder.

As the main charge burns it pressurizes the high pressure chamber 50 throughout the burning of the main charge. This main charge 62 will nearly completely burn up as the pressure increases to be a very high pressure, such as a pressure in access of five thousand (5,000) PSI. The actual peak value for the pressure in the high pressure chamber 50 is controlled by the strength of the high trangible pressure diaphragm 52. When the pressure in the high pressure chamber 50 reaches the preset value of the strength of the high pressure diaphragm 52, the diaphragm bursts which provides for an escape of the high pressure gases into the low pressure chamber 44.

As the high pressure gases escape into the low pressure chamber 44 the high pressure gases rapidly expand, which in turn significantly lowers the pressure of the gases escaping into the low pressure chamber 44. In addition, because of the expansion of the high pressure gases into the low pressure chamber, adiabatic cooling takes place resulting in the extinguishing of any residual flame from the high pressure chamber 50.

The pressure in the low pressure chamber 44 is of a significantly lower value than the pressure in the high pressure chamber and as an example the maximum pressure in the low pressure chamber may range between 250 to 300 PSI. When the pressure in the low pressure chamber reaches a preset valve, the low pressure diaphragm 46 bursts. When the low pressure diaphragm bursts this allows for the escaping gases to provide a propelling force directed through the barrel 30.

At the end of the shaft 32, there is formed a piston 66 consisting of disk members 68 and 70 welded around the shaft 32 at spaced positions from each other. The gas escaping from the low pressure chamber 44 impinges on the end of the disk 70 to provide for a propelling force to thrust the shaft out of the barrel 30. The use of the spaced disk members 68 and 70 insures that the shaft 32 does not bind in the barrel and provides for a straight movement of the shaft and piston out of the barrel.

Upon the initial movement of the shaft 32, the upper end of the shaft strikes against a protective cover 72 which is held on by friction fit. The upward movement of the shaft 32 thereby knocks the cover 72 aside. The cover 72 is used to seal the end of the barrel and specifically seals the ring 34 to protect the ring from weathering and corrosion which could lock the ring in position. As the shaft 32 moves upward, eventually the disk 68 engages the ring 34 which is held in by a friction fit at the end of the barrel. As the disk 68 moves upward, it frees the ring 34 from the end of the barrel 30. The ring 34, to which the line 18 is connected through the coupling line 27, is carried along with the shaft 32 as it is propelled out into the ocean. It can be seen that the shaft 32 is hollow and is sealed at both ends so that the shaft 32 is actually buoyant and will float when propelled out into the ocean.

FIG. 6 illustrates the barge 10 in a disabled state since the line 20 is shown to be parted. A tugboat 100 is shown to be towing another barge 102 with a tow line 104, but with the towline 20 originally connected to the barge 10, broken so that the barge 10 is now disabled. It should be noted that the barge 102 also includes a remotely actuated towline throwing gun similar to the one positioned on the barge 10. The tug 100 is shown to have been manuevered into a position to retrieve the auxiliary towline 18, which is to be projected from the barge 10. The projection path for the auxiliary towline 18 is shown by dotted line 106. The tug 100 will now proceed in a path, as shown by the dotted line 108, to retrieve the auxiliary towline and to reattach the barge 10 for continued towing.

The actuation of the remotely actuated towline throwing device is accomplished using a transmitter located on the tug 100 and with a receiver located on the barge 10. This receiver has been previously designated by reference character 36. The barge 102 may also have a receiver, but with each receiver having different frequencies to insure that only the proper remotely actuated device is actuated. The transmitter includes a two channel pulse code modulated transmitter 110 which transmits through an antena 112. Radio signals 114 are received by an antena 116 located on the receiver 36. Specifically, the receiver 36 includes a complementary two channel pulse code modulated receiver 118 to decode the signals transmitted by the transmitter 110.

In order to insure that the towline throwing device is not inadvertently or accidentally fired, the transmitter includes a fail-safe system consisting of a key switch 120 plus separate channel switches 122 and 124. All three switches must be energized at the same time in order to prevent accidental or inadvertent firing. The use of separate switches 122 and 124 for the separate channels also allows each channel to be checked without firing by actuating either one of the switches 122 and 124.

Specifically, as shown in FIG. 4, the two channel receiver 118 controls a pair of servos 126 and 128 to control pairs of switches 130 through 132. The switches 130 and 131 are controlled by the servo 132 and switches 132 and 133 are controlled by the servo 128. This allows the individual channels to be tested to determine that the transmitter 110 is properly sending out a signal and that the receiver 118 is properly receiving the signal. Specifically, either of the switches 122 and 124 may be energized to activate the complementary one of the servo 126 or 128 to close switches 131 or 133 to individually test the two channels by lighting the light 38.

Figure 5:
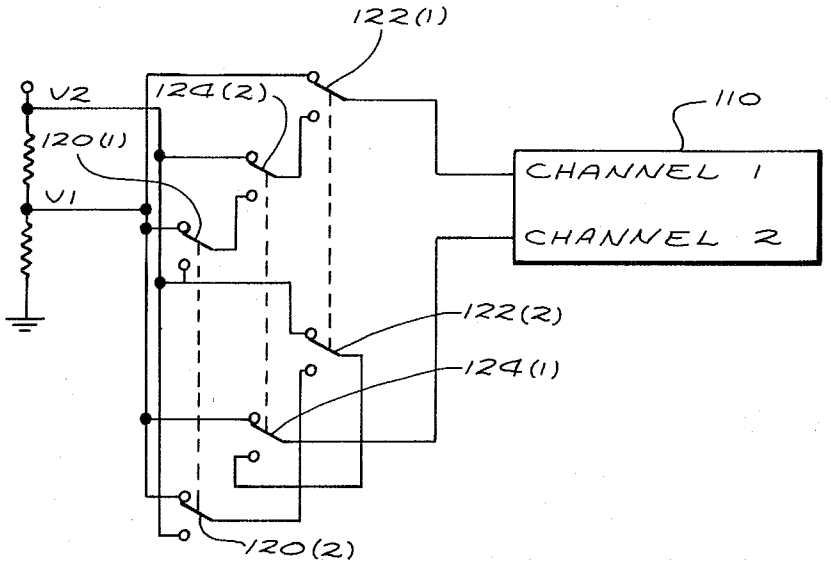
FIG. 5 is a detail of the switching interlock to prevent inadvertent actuation of the remotely actuated device.

Actually, the switches 120, 122 and 124 are all double pole switches as shown in FIG. 5 and control switching between voltage level V1 which is "off" to voltage level V2 which is "on". The actuation of either of the switches 122 or 124 automatically disables the other no matter what position for the key switch 120. However, if either of the switches 122 and 124 is energized without energizing the key switch 120, the light 38 will be energized without energizing the pressure cartridge or squib 58. If the key switch 120 is energized and either of the switches 120 or 122 is energized, again the light 38 will be energized without energizing the squib 58. Only if the key switch 120 and both switches 122 and 124 are energized at the same time, will both servos 126 and 128 be energized to control the switches 130 and 132 so that both the light and the squib 58 will be energized.

As shown in FIGS. 4 an 5, the transmitter 110 includes both a first and second channel and with a switching between the voltages V1 and V2 to control the transmission of coded signals from the two channels. The individual poles of the two pole switches 120, 122 and 124 are represented by the indications (1) and (2) and with the switches normally in the positions shown in FIG. 5. As explained above, this switching interlock prevents inadvertent firing of the squib 58 while allowing for the testing of the transmitter and receiver and also of the separate channels for the transmitter and receiver by lighting the light 38.

The present invention therefore provides for a remotely actuated line throwing device which has specific use for throwing out an auxiliary line from a disabled unmanned vessel. The invention includes a unique structure using a pair of pressure chambers, one within the other, and with a high pressure chamber initially actuated to produce a high pressure gas and with this chamber located within a low pressure chamber, and with the chambers interconnected by a diaphragm which breaks when the chamber reaches a predetermined value. As the high pressure gas escapes from the high pressure chamber to the low pressure chamber, adiabatic cooling takes place resulting in the extinguishing of any residual flame from the burning of fuel in the high pressure chamber. This insures that the gun may be safely operated on board an unattended vessel which may be carrying combustible material. As the pressure builds up in the low pressure chamber this eventually breaks a low pressure diaphragm to apply the expelling gases against a piston which supports a shaft member. The shaft member and piston in turn carry a auxiliary line which is carried along with the shaft out over the ocean. The line may be actually thrown out a considerable distance such as 200 to 300 feet to be sufficiently clear of the disabled vessel and allow the line to be easily picked up by the tug to again bring the disabled vehicle under tow.

The invention includes a fail-safe actuating mechanism including a two channel transmitter and receiver so as to insure that the gun is not inadvertently energized. The invention also includes a switching interlock to allow for the transmitter and receiver to be tested by lighting up a light to determine that the signaling system is properly operating.

It is also to be appreciated that although the invention has been described with reference to a line throwing gun for the retrieval of a disabled barge, that other uses may be made of the invention, such as uses on land and in the air. These other uses may provide for the remote actuation of the device for throwing a projectile whether that projectile carries a line or not.

Although the invention has been described with reference to a particular embodiment, it is to be appreciated that other adaptations and modifications may be made and the invention is only to be limited by the appended claims.

We claim:

1. A throwing device including, a throwing gun formed by a high pressure chamber located within a low pressure chamber and with a first frangible diaphragm having a predetermined breaking pressure interconnecting the two chambers and a second frangible diaphragm closing off the low pressure chamber and having a predetermined breaking pressure lower than the breaking pressure of the first diaphragm, a barrel mounted adjacent to and extending from the second frangible diaphragm, a projectile located within the barrel, a main change substantially located within the high pressure chamber and an ignition charge coupled to the main charge for igniting the main charge upon activation of the ignition charge, the ignition of the main charge providing for the production of rapid burning forming gas having an increasing pressure within the high pressure chamber until the pressure reaches the predetermined breaking pressure for the first frangible diaphragm wherein the first diaphragm bursts to allow the high pressure gas to escape by rapidly expanding into the low pressure chamber until the pressure reaches the predetermined breaking pressure for the second frangible diaphragm wherein the second diaphragm bursts to allow the low pressure gas to escape into the barrel to propel the projectile located within the barrel, and the high and low pressure chambers are both formed as cylinders and wherein the high pressure cylinder extends within the low pressure cylinder through a side portion of the low pressure cylinder.

2. The throwing device of claim 1 wherein, the second frangible diaphragm is located across an end wall of the low pressure cylinder and with a central axis common to both the barrel and the low pressure cylinder.

3. The throwing device of claim 1 wherein the projectile is formed by a shaft member having a piston portion located within the barrel and adjacent the second frangible diaphragm to have the low pressure gas directed against the end of the piston to propel the shaft member.

4. The throwing device of claim 1 additionally including an end wall for the high pressure chamber and wherein the main charge extends through the end wall to lie substantially within the high pressure chamber and with the ignition charge coupled to the main charge and extending though the end wall in a direction opposite to the main charge to provide access to the ignition charge.

5. The throwing device of claim 4 wherein the ignition charge is formed by a small charge and a detonator.

6. The throwing device of claim 1 additionally including a line attached to the projectile to throw the line along with the projectile.

7. The throwing device of claim 6 wherein the projectile is formed by a shaft member having a piston portion located within the barrel and adjacent the second frangible diaphragm to have the low pressure gas directed against the end of the piston to propel the shaft member and additionally including a ring positioned around the shaft and located at the end of the barrel and with the line attached to the ring.

8. The throwing device of claim 7 additionally including a removable cover located at the end of the barrel to seal the barrel and cover the end of the shaft and the ring and with the cover pushed aside by the end of the shaft when the shaft is propelled.

9. The throwing device of claim 1 additionally including a removable cover located at the end of the barrel to seal the barrel and with the cover pushed aside by the projectile when the projectile is propelled.

10. The throwing device of claim 1 additionally including a remote actuator to remotely actuate the ignition charge from a remote location and with the remote actuator including a transmitter to transmit an actuating signal and a receiver to receive the actuating signal and with the receiver coupled to the ignition charge to actuate the ignition charge upon reception of the actuating signal.

11. The throwing device of claim 10 wherein the transmitter and receiver each include two separate channels for transmitting and receiving individual actuating signals on the two separate channels and with the actuating of the ignition charge only upon transmission and reception of the individual actuation signals on both channels simultaneously.

12. The throwing device of claim 11 additionally including a keyed master control having on and off positions coupled to the two channel transmitter to prevent transmission of the individual actuation signals on both channels simultaneously unless the keyed master control is in the on position.

13. The throwing device of claim 12 additionally including an indicator coupled to the receiver and with the transmission and reception of either of the individual actuator signals on either of the channels providing an indication by the indicator.

14. A remotely actuated throwing device including, a throwing gun including, a high pressure chamber located within a low pressure chamber, a first member having a predetermined opening pressure interconnecting the two chambers, a second member closing off the low pressure chamber and having a predetermined opening pressure lower than the opening pressure of the first member, a barrel mounted adjacent to and extending from the second member, a projectile located within the barrel, a main charge substantially located within the high pressure chamber, means coupled to the main charge for igniting the main charge, the ignition of the main charge providing for the production of rapid burning forming gas having an increasing pressure within the high pressure chamber until the pressure reaches the predetermined opening pressure for the first member wherein the first member opens to allow the high pressure gas to escape by rapidly expanding into the low pressure chamber until the pressure reaches the predetermined opening pressure for the second member wherein the second member opens to allow the low pressure gas to escape into the barrel to propel the projectile located within the barrel, a remote actuator to remotely actate the main charge including, a transmitter for transmitting an actuating signal, a receiver coupled to the means for igniting the main charge and respective to the transmitted actuating signal for controlling the means to ignite the main charge upon reception of the actuating signal, and the high and low pressure chambers both formed as cylinders and wherein the high pressure cylinder extends within the low pressure cylinder through a side portion of the low pressure cylinder.

15. The remotely actuated throwing device of claim 14 wherein the transmitter and receiver each include two separate channels for transmitting and receiving individual actuating signals on the two separate channels and with the controlling of the means for igniting only upon transmission and reception of the individual actuation signals on both channels simultaneously.

16. The remotely actuated throwing device of claim 15 additionally including a keyed master control having on and off positions coupled to the two channel transmitter to prevent transmission of the individual actuation signals on both channels simultaneously unless the keyed master control is in the on position.

17. The remotely actuated throwing device of claim 16 additionally including an indicator coupled to the receiver and with the transmission and reception of either of the individual actuator signals on either of the channels providing an indication by the indicator.

18. The remotely actuated throwing device of claim 14 wherein, the second member is located across an end wall of the low pressure cylinder and with a central axis common to both the barrel and the low pressure cylinder.

19. The remotely actuated throwing devie of claim 14 wherein the projectile is formed by a shaft member having a piston portion located within the barrel and adjacent the second member to have the low pressure gas directed against the end of the piston to propel the shaft member.

20. The remotely actuated throwing device of claim 14 additionally including an end wall for the high pressure chamber and wherein the main charge extends through the end wall to lie substantially within the high pressure chamber and with the means for igniting the main charge extends though the end wall in a direction opposite to the main charge to provide access to the means for igniting.

21. The remotely actuated throwing device of claim 20 wherein the means for igniting is formed by a small charge and a detonator.

22. The remotely actuated throwing device of claim 14 additionally including a line attached to the projectile to throw the line along with the projectile.

23. The remotely actuated throwing device of claim 22 wherein the projectile is formed by a shaft member having a piston portion located within the barrel and adjacent the second member to have the low pressure gas directed against the end of the piston to propel the shaft member and additionally including a ring positioned around the shaft and located at the end of the barrel and with the line attached to the ring.

24. The remotely actuated throwing device of claim 23 additionally including a removable cover located at the end of the barrel to seal the barrel and cover the end of the shaft and the ring and with the cover pushed aside by the end of the shaft when the shaft is propelled.

25. The remotely actuated throwing device of claim 14 additionally including a removable cover located at the end of the barrel to seal the barrel and with the cover pushed aside by the projectile when the projectile is propelled.

26. A remotely actuated line throwing device including, a throwing gun including a pressure chamber and a barrel mounted adjacent to and extending from the pressure chamber, a projectile located within the barrel, and with the projectile formed by a shaft member having a piston portion located within the barrel;

means for providing a rapid increase in pressure within the pressure chamber to have the pressure directed against the end of the piston to propel the shaft member, a line attached to the projectile to throw the line along with the projectile, a remote actuator to remotely actuate the means for providing the rapid increase in pressure including, a transmitter for transmitting an actuating a signal, a receiver coupled to the means for providing the rapid increase in pressure and responsive to the transmitted actuating signal for controlling the means to provide the rapid increase in pressure upon reception of the actuating signal, and a ring positioned around the shaft and located at the end of the barrel and with the line attached to the ring.

27. The remotely actuating line throwing device of claim 26 additionally including a removable cover located at the end of the barrel to seal the barrel and cover the end of the shaft and the ring and with the cover pushed aside by the end of the shaft when the shaft is propelled.

28. The remotely actuated Iine throwing device of claim 26 wherein the transmitter and receiver each include two separate channels for transmitting and receiving individual actuating signals on the two separate channels and with the actuating of the means for providing the rapid increase in pressure only upon transmission and reception of the individual actuation signals on both channels simultaneously.

29. The remotely actuating line throwing device of claim 28 additionally including a keyed master control having on and off positions coupled to the two channel transmitter to prevent transmission of the individual actuation signals on both channels simultaneously unless the keyed master control is in the on position.

30. The remotely actuated line throwing device of claim 29 additionally including an indicator coupled to the receiver and with the transmission and reception of either of the individual actuator signals on either of the channels providing an indication by the indicator.

31. A method of remotely actuating a line throwing device including the following steps, providing a throwing gun at a remote location and wherein the remote location is an unmanned vessel, providing a projectile located within the gun, attaching a line to the projectile to throw the line along with the projectile, providing a transmitter at a location different than the remote location for transmitting an acutuating signal and wherein the location of the transmitter is a manned vessel, providing a receiver coupled to the throwing gun for actuating the throwing gun in response to the transmitted actuating signal, controlling the transmitter to transmit the actuating signal, receiving the actuating signal by the receiver, and actuating the throwing gun in accordance with the received actuating signal to throw the projectile and the line a distance from the throwing gun, and maneuvering the manned vessel to pick up the thrown projectile and line.

32. The method of claim 31 wherein the transmitter and receiver each include two separate channels for transmitting and receiving individual actuating signals on the two separate channels and with the step of controlling the transmitter including transmitting the individual actuating signals simultaneously on the two separate channels.

33. The method of claim 32 additionally including providing a keyed master control having on and off positions coupled to the two channel transmitter to prevent transmission of the individual actuation signals on both channels simultaneously and including the step of controlling the keyed master control to the on position simultaneous with the transmission of the individual actuating signals on the two separate channels.

34. The method of claim 32 additionally including providing an indicator coupled to the receiver and with the step of transmitting and receiving of either of the individual actuator signals on either of the two separate channels providing an indication by the indicator.

35. The method of claim 31 wherein the projectile is hollow so that the projectile and line float to facilitate the pickup during manuevering of the manned vessel.

36. A throwing device including, a throwing gun formed by a high pressure chamber located within a low pressure chamber and with a first frangible diaphragm having a predetermined breaking pressure interconnecting the two chambers and a second frangible diaphragm closing off the low pressure chamber and having a predetermined breaking pressure lower than the breaking pressure of the first diaphragm, a barrel mounted adjacent to and extending from the second frangible diaphragm, a projectile located within the barrel, a main charge substantially located within the high pressure chamber and an ignition charge coupled to the main charge for igniting the main charge upon activation of the ignition charge, the ignition of the main charge providing for the production of rapid burning forming gas having an increasing pressure within the high pressure chamber until the pressure reaches the predetermined breaking pressure for the first frangible diaphragm wherein the first diaphragm bursts to allow the high pressure gas to escape by rapidly expanding into the low pressure chamber until the pressure reaches the predetermined breaking pressure for the second frangible diaphragm wherein the second diaphragm bursts to allow the low pressure gas to escape into the barrel to propel the projectile located within the barrel, and a line attached to the projectile to throw the line along with the projectile and wherein the projectile is formed by a shaft member having a piston portion located within the barrel and adjacent the second frangible diaphragm to have the low pressue gas directed against the end of the piston to propel the shaft member and additionally including a ring positioned around the shaft and located at the end of the barrel and with the line attached to the ring.

37. The throwing device of claim 36 wherein the high and low pressure chambers are both formed as cylinders.

38. The throwing device of claim 37 wherein, the second frangible diaphragm is located across an end wall of the low pressure cylinder and with a central axis common to both the barrel and the low pressure cylinder.

39. The throwing device of claim 36 wherein the projectile is formed by a shaft member having a piston portion located within the barrel and adjacent the second frangible diaphragm to have the low pressure gas directed against the end of the piston to propel the shaft member.

40. The throwing device of claim 36 additionally including an end wall for the high pressure chamber and wherein the main charge extends through the end wall to lie substantially within the high pressure chamber and with the ignition charge coupled to the main charge and extending though the end wall in a direction opposite to the main charge to provide access to the ignition charge.

41. The throwing device of claim 40 wherein the ignition charge is formed by a small charge and a detonator.

42. The throwing device of claim 36 additionally including a removable cover located at the end of the barrel to seal the barrel and cover the end of the shaft and the ring and with the cover pushed aside by the end of the shaft when the shaft is propelled.

43. The throwing device of claim 36 additionally including a remote actuator to remotely actuate the ignition charge from a remote location and with the remote actuator including a transmitter to transmit an actuating signal and a receiver to receive the actuating signal and with the receiver coupled to the ignition charge to actuate the ignition charge upon reception of the actuating signal.

44. The throwing device of claim 43 wherein the transmitter and receiver each include two separate channels for transmitting and receiving individual actuating signals on the two separate channels and with the actuating of the ignition charge only upon transmission and reception of the individual actuation signals on both channels simultaneously.

45. The throwing device of claim 44 additionally including a keyed master control having on and off positions coupled to the two channel transmitter to prevent transmission of the individual actuation signals on both channels simultaneously unless the keyed master control is in the on position.

46. The throwing device of claim 45 additionally including an indicator coupled to the receiver and with the transmission and reception of either of the individual actuator signals on either of the channels providing an indication by the indicator.

47. A remotely actuated throwing device including, a throwing gun including, a high pressure chamber located within a low pressure chamber, a first member having a predetermined opening pressure interconnecting the two chambers, a second member closing off the low pressure chamber and having a predetermined opening pressure lower than the opening pressure of the first member, a barrel mounted adjacent to and extending from the second member, a projectile located within the barrel, a main charge substantially located within the high pressure chamber, means coupled to the main charge for igniting the main charge, the ignition of the main charge providing for the production of rapid burning forming gas having an increasing pressure within the high pressure chamber until the pressure reaches the predetermined opening pressure for the first member wherein the first member opens to allow the high pressure gas to escape by rapidly expanding into the low pressure chamber until the pressure reaches the predetermined opening pressure for the second member wherein the second member opens to allow the low pressure gas to escape into the barrel to propel the projectile located within the barrel, a remote actuator to remotely actuate the main charge including, a transmitter for transmitting an actuating signal, and a receiver coupled to the means for igniting the main charge and responsive to the transmitted actuating signal for controlling the means to ignite the main charge upon reception of the actuating signal and a line attached to the projectile to throw the line along with the projectile, and wherein the projectile is formed by a shaft member having a piston portion located within the barrel and adjacent the second member to have the low pressure gas directed against the end of the piston to propel the shaft member and additionally including a ring positioned around the shaft and located at the end of the barrel and with the line attached to the ring.

48. The remotely actuated throwing device of claim 47 wherein the transmitter and receiver each include two separate channels for transmitting and receiving individual actuating signals on the two separate channels and with the controlling of the means for igniting only upon transmission and reception of the individual actuation signals on both channels simultaneously.

49. The remotely actuated throwing device of claim 48 additionally including a keyed master control having on and off positions coupled to the two channel transmitter to prevent transmission of the individual actuation signals on both channels simultaneously unless the keyed master control is in the on position.

50. The remotely actuated throwing device of claim 49 additionally including an indicator coupled to the receiver and with the transmission and reception of either of the individual actuator signals on either of the channels providing an indication by the indicator.

51. The remotely actuated throwing device of claim 47 wherein the high and low pressure chambers are both formed as cylinders.

52. The remotely actuated throwing device of claim 51 wherein, the second member is located across an end wall of the low pressure cylinder and with a central axis common to both the barrel and the low pressure cylinder.

53. The remotely actuated throwing devie of claim 47 wherein the projectile is formed by a shaft member having a piston portion located within the barrel and adjacent the second member to have the low pressure gas directed against the end of the piston to propel the shaft member.

54. The remotely actuated throwing device of claim 47 additionally including an end wall for the high pressure chamber and wherein the main charge extends through the end wall to lie substantially within the high pressure chamber and with the means for igniting the main charge extends through the end wall in a direction opposite to the main charge to provide access to the means for igniting.

55. The remotely actuated throwing device of claim 54 wherein the means for igniting is formed by a small charge and a detonator.

56. The remotely actuated throwing device of claim 47 additionally including a removable cover located at the end of the barrel to seal the barrel and cover the end of the shaft and the ring and with the cover pushed aside by the end of the shaft when the shaft is propelled.

* * * * *